US010531216B2

(12) United States Patent
Mor et al.

(10) Patent No.: US 10,531,216 B2
(45) Date of Patent: Jan. 7, 2020

(54) SYNTHESIS OF SIGNALS FOR IMMERSIVE AUDIO PLAYBACK

(71) Applicant: 3D SPACE SOUND SOLUTIONS LTD., Rishon Lezion (IL)

(72) Inventors: Yoav Mor, Rishon Lezion (IL); Benjamin Kohn, Modiin (IL); Alex Etlin, Yorba Linda, CA (US)

(73) Assignee: SPHEREO SOUND LTD., Rishon Lezion (IL)

( * ) Notice: Subject to any disclaimer, the term of this patent is extended or adjusted under 35 U.S.C. 154(b) by 0 days.

(21) Appl. No.: 16/061,343

(22) PCT Filed: Jan. 4, 2017

(86) PCT No.: PCT/IB2017/050018
§ 371 (c)(1),
(2) Date: Jun. 12, 2018

(87) PCT Pub. No.: WO2017/125821
PCT Pub. Date: Jul. 27, 2017

(65) Prior Publication Data

US 2019/0020963 A1 Jan. 17, 2019

Related U.S. Application Data

(60) Provisional application No. 62/432,578, filed on Dec. 11, 2016, provisional application No. 62/400,699, (Continued)

(51) Int. Cl.
*H04S 3/00* (2006.01)
*H04S 7/00* (2006.01)

(52) U.S. Cl.
CPC ..... *H04S 3/008* (2013.01); *H04S 7/307* (2013.01); *H04S 3/004* (2013.01); *H04S 2400/01* (2013.01); *H04S 2420/01* (2013.01)

(58) Field of Classification Search
CPC ..... H04S 3/004; H04S 3/008; H04S 7/307; H04S 2400/01; H04S 2420/01
See application file for complete search history.

(56) References Cited

U.S. PATENT DOCUMENTS 5,371,799 A 12/1994 Lowe et al.
5,742,689 A 4/1998 Tucker et al.
(Continued)

FOREIGN PATENT DOCUMENTS

WO 99/31938 A1 6/1999

OTHER PUBLICATIONS

Farge et al., "Wavelet transforms and their applications to turbulence", Annual Review of Fluid Mechanics, vol. 24, pp. 395-457, 1992.

(Continued)

*Primary Examiner* — Mark Fischer
(74) *Attorney, Agent, or Firm* — Kligler & Associates Patent Attorneys Ltd

(57) ABSTRACT

A method for synthesizing sound includes receiving one or more first inputs (80), each including a respective monaural audio track (82). One or more second inputs are received, indicating respective three-dimensional (3D) source locations having azimuth and elevation coordinates to be associated with the first inputs. Each of the first inputs is assigned respective left and right filter responses based on filter response functions that depend upon the azimuth and elevation coordinates of the respective 3D source locations. Left and right stereo output signals (94) are synthesized by applying the respective left and right filter responses to the first inputs.

34 Claims, 5 Drawing Sheets

Related U.S. Application Data filed on Sep. 28, 2016, provisional application No. 62/280,134, filed on Jan. 19, 2016.

(56) References Cited

U.S. PATENT DOCUMENTS

| | | | | |
|---|---|---|---|---|
| 6,421,446 | B1 | 7/2002 | Cashion et al. | |
| 6,498,857 | B1 | 12/2002 | Sibbald | |
| 7,167,567 | B1 | 1/2007 | Sibbald et al. | |
| 8,638,959 | B1 | 1/2014 | Hall | |
| 2005/0047618 | A1* | 3/2005 | Davis | H04R 5/04 381/309 |
| 2005/0273324 | A1 | 12/2005 | Yi | |
| 2006/0117261 | A1 | 6/2006 | Sim et al. | |
| 2006/0177078 | A1* | 8/2006 | Chanda | H04S 1/005 381/309 |
| 2010/0191537 | A1 | 7/2010 | Breenbaart | |
| 2014/0355765 | A1 | 12/2014 | Kulavik et al. | |
| 2015/0063553 | A1 | 3/2015 | Gleim | |
| 2015/0223002 | A1 | 8/2015 | Mehta et al. | |
| 2016/0007133 | A1 | 1/2016 | Mateos Sole et al. | |
| 2016/0066118 | A1* | 3/2016 | Oh | G10L 19/008 381/303 |
| 2017/0013389 | A1* | 1/2017 | Kitazawa | H04S 7/303 |

OTHER PUBLICATIONS

Watkins, "Psychoacoustical aspects of synthesized vertical locale cues", Journal Acoustical Society of America, vol. 63, No. 4, pp. 1152-1165, Apr. 1978.

Goupillaud et al., "Cycle-octave and related transforms in seismic signal analysis", Geoexploration, vol. 23, pp. 85-102, 1984/1985.

Haar., "Zur Theorie der orthogonalen Funktionensysteme", Mathematische Annalen, vol. 69, issue 3, pp. 331-332, Sep. 1910.

Taplidou, "Nonlinear analysis of wheezes using wavelet bicoherence", Computers in Biology and Medicine, vol. 37, pp. 563-570, 2007.

Taplidou et al., "Nonlinear characteristics of wheezes as seen in the wavelet higher-order spectra domain", Proceedings of the 28th IEEE Embs Annual International Conference, New York, USA, pp. 4506-4509, Aug. 30-Sep. 3, 2006.

Van Milligen et al., "Wavelet bicoherence: A new turbulence analysis tool", Physics of Plasmas 2, vol. 8, pp. 3017-3032, Aug. 1995.

Von Tscharner, "Intensity analysis in time-frequency space of surface myoelectric signals by wavelets of specified resolution", Journal of Electromyography and Kinesiology, vol. 10, pp. 433-445, 2000.

Von Tscharner, "Time-frequency and principal-component methods for the analysis of EMGs recorded during a mildly fatiguing exercise on a cycle ergometer", Journal of Electromyography and Kinesiology, vol. 12, pp. 479-492, 2002.

Wang et al., "Optimising coherence estimation to assess the functional correlation of tremor-related activity between the subthalamic nucleus and the forearm muscles", Journal of Neuroscience Methods, vol. 136, pp. 197-205, 2004.

Wang et al., "Time-frequency analysis of transient neuromuscular events: dynamic changes in activity of the subthalamic nucleus and forearm muscles related to the intermittent resting tremor", Journal of Neuroscience Methods, vol. 145, pp. 151-158, 2005.

Keyrouz et al., "Binaural source localization and spatial audio reproduction for telepresence applications" Presence: Teleoperators and Virtual Environments , vol. 16, No. 5, pp. 509-522, Sep. 30, 2007.

Susnik, "An elevation coding method for auditory displays", Applied Acoustics, vol. 69, issue 3, pp. 233-241, Mar. 2008.

Grinsted et al.,"Application of the cross wavelet transform and wavelet coherence to geophysical time series", Nonlinear Processes in Geophysics, vol. 11, pp. 561-566, 2004.

Maraun et al., "Cross wavelet analysis: significance testing and pitfalls", Nonlinear Processes in Geophysics , vol. 11, pp. 505-514, 2004.

Torrence et al., "A Practical Guide to Wavelet Analysis", Bulletin of the American Meteorological Society, vol. 79, pp. 61-78, 1998.

Von Tscharner et al., "Subspace Identification and Classification of Healthy Human Gait", PLOS One 8, vol. 8, issue 7, 8 pages, Jul. 2013.

Gardner et al., "HRTF Measurements of a KEMAR Dummy—Head Microphone", 2 Pages, May 18, 1994.

Susnik et al .,"Coding of Elevation in Acoustic Image of Space", Proceedings of Acoustics, pp. 145-150, Nov. 9-11, 2005.

International Application # PCT/IB2017/050018 search report dated Jan. 2015.

Psychoacoustics of Spatial Hearing—CIPIC International Laboratory, 6 pages, Feb. 25, 2011 http://interface.cipic.ucdavis.edu/sound/tutorial/psych.htm.

"A complete, cross-platform solution to record, convert and stream audio and video", FFmpeg, 9 pages, Sep. 29, 2015 (https://web.archive.org/web/20151201044636/https://www.ffmpeg.org/).

European Application 17741145.1 Search Report dated Jul. 9, 2019.

* cited by examiner

SYNTHESIS OF SIGNALS FOR IMMERSIVE AUDIO PLAYBACK

CROSS-REFERENCE TO RELATED APPLICATION

This application claims the benefit of U.S. Provisional Patent Application 62/280,134, filed Jan. 19, 2016, of U.S. Provisional Patent Application 62/400,699, filed Sep. 28, 2016, and of U.S. Provisional Patent Application 62/432,578, filed Dec. 11, 2016, all of which are incorporated herein by reference.

FIELD OF THE INVENTION

The present invention relates generally to processing of audio signals, and particularly to methods, systems and software for generation and playback of audio output.

BACKGROUND

In recent years, advances in audio recording and reproduction have facilitated the development of immersive "surround sound," in which audio is played back from multiple speakers that surround the listener. Surround-sound systems for home use, for example, include arrangements known as "5.1" and "7.1," in which audio is recorded for playback over either five or seven channels (three speakers in front of the listener and additional speakers at the sides and possibly behind or above the listener) plus a sub-woofer.

On the other hand, large numbers of users today listen to music and other audio content through stereo headphones, typically via mobile audio players and smartphones. Multi-channel surround recordings are generally down-mixed from 5.1 or 7.1 channels to two channels for this purpose, and the listener therefore loses much of the immersive audio experience that the surround recording is able to provide.

Various techniques for down-mixing multi-channel sound to stereo have been described in the patent literature. For example, U.S. Pat. No. 5,742,689 describes a method for processing multi-channel audio signals, wherein each channel corresponding to a loudspeaker placed in a particular location in a room, in such a way as to create, over headphones, the sensation of multiple "phantom" loudspeakers placed throughout the room. Head Related Transfer Functions (HRTFs) are chosen according to the elevation and azimuth of each intended loudspeaker relative to the listener. Each channel is filtered with an HRTF such that when combined into left and right channels and played over headphones, the listener senses that the sound is actually produced by phantom loudspeakers placed throughout the "virtual" room.

As another example, U.S. Pat. No. 6,421,446 describes apparatus for creating 3D audio imaging over headphones using binaural synthesis including elevation. The apparent location of sound signals as perceived by a person listening to the sound signals over headphones can be positioned or moved in azimuth, elevation and range by a range control block and a location control block. Several range control blocks and location control blocks can be provided depending on the number of input sound signals to be positioned or moved.

SUMMARY

Embodiments of the present invention that are described hereinbelow provide improved methods, systems and software for synthesizing audio signals.

There is therefore provided, in accordance with an embodiment of the invention, a method for synthesizing sound, which includes receiving one or more first inputs, each first input including a respective monaural audio track. One or more second inputs are received, indicating respective three-dimensional (3D) source locations having azimuth and elevation coordinates to be associated with the first inputs. Each of the first inputs is assigned respective left and right filter responses based on filter response functions that depend upon the azimuth and elevation coordinates of the respective 3D source locations. Left and right stereo output signals are synthesized by applying the respective left and right filter responses to the first inputs.

In some embodiments, the one or more first inputs include a plurality of first inputs, and synthesizing the left and right stereo output signals includes applying the respective left and right filter responses to each of the first inputs to generate respective left and right stereo components, and summing the left and right stereo components over all of the first inputs. In a disclosed embodiment, summing the left and right stereo components includes applying a limiter to the summed components in order to prevent clipping upon playback of the output signals.

Additionally or alternatively, at least one of the second inputs specifies a 3D trajectory in space, and assigning the left and right filter responses includes specifying, at each of a plurality of points along the 3D trajectory, filter responses that vary over the trajectory responsively to the azimuth and elevation coordinates of the points. Synthesizing the left and right stereo output signals includes sequentially applying to the first input that is associated with the at least one of the second inputs the filter responses that are specified for the points along the 3D trajectory.

In some embodiments, receiving the one or more second inputs includes receiving a start point and a start time of the trajectory, receiving an end point and an end time of the trajectory, and automatically computing the 3D trajectory between the start point and the end point such that the trajectory is traversed from the start time to the end time. In a disclosed embodiment, automatically computing the 3D trajectory includes calculating a path over a surface of a sphere that is centered at an origin of the azimuth and elevation coordinates.

In some embodiments, the filter response functions include a notch at a given frequency, which varies as a function of the elevation coordinates.

Further additionally or alternatively, the one or more first inputs include a first plurality of audio input tracks, and synthesizing the left and right stereo output signals includes spatially upsampling the first plurality of the input audio tracks in order to generate a second plurality of synthesized inputs, having synthesized 3D source locations with respective coordinates different from the respective 3D source locations associated with the first inputs. The synthesized inputs are filtered using the filter response functions computed at the azimuth and elevation coordinates of the synthesized 3D source locations. After filtering the first inputs using the respective left and right filter responses, the filtered synthesized inputs are summed with the filtered first inputs to produce the stereo output signals.

In some embodiments, spatially upsampling the first plurality of the input audio tracks includes applying a wavelet transform to the input audio tracks to generate respective spectrograms of the input audio tracks, and interpolating between the spectrograms according to the 3D source locations to generate the synthesized inputs. In one embodiment, interpolating between the spectrograms includes computing an optical flow function between points in the spectrograms.

In a disclosed embodiment, synthesizing the left and right stereo output signals includes extracting low-frequency components from the first inputs, and applying the respective left and right filter responses includes filtering the first inputs after extraction of the low-frequency components, and then adding the extracted low-frequency components to the filtered first inputs.

Additionally or alternatively, when the 3D source locations have range coordinates that are to be associated with the first inputs, synthesizing the left and right stereo outputs can include further modifying the first inputs responsively to the associated range coordinates.

There is also provided, in accordance with an embodiment of the invention, apparatus for synthesizing sound, including an input interface configured to receive one or more first inputs, each first input including a respective monaural audio track, and to receive one or more second inputs indicating respective three-dimensional (3D) source locations having azimuth and elevation coordinates to be associated with the first inputs. A processor is configured to assign to each of the first inputs respective left and right filter responses based on filter response functions that depend upon the azimuth and elevation coordinates of the respective 3D source locations, and to synthesize left and right stereo output signals by applying the respective left and right filter responses to the first inputs.

In a disclosed embodiment, the apparatus includes an audio output interface, including left and right speakers, which are configured to play back the left and right stereo output signals, respectively.

There is additionally provided, in accordance with an embodiment of the invention, a computer software product, including a non-transitory computer-readable medium in which program instructions are stored, which instructions, when read by a computer, cause the computer to receive one or more first inputs, each first input including a respective monaural audio track, and to receive one or more second inputs indicating respective three-dimensional (3D) source locations having azimuth and elevation coordinates to be associated with the first inputs. The instructions cause the computer to assign to each of the first inputs respective left and right filter responses based on filter response functions that depend upon the azimuth and elevation coordinates of the respective 3D source locations, and to synthesize left and right stereo output signals by applying the respective left and right filter responses to the first inputs.

The present invention will be more fully understood from the following detailed description of the embodiments thereof, taken together with the drawings in which:

DETAILED DESCRIPTION OF EMBODIMENTS

Overview

Figure 1:
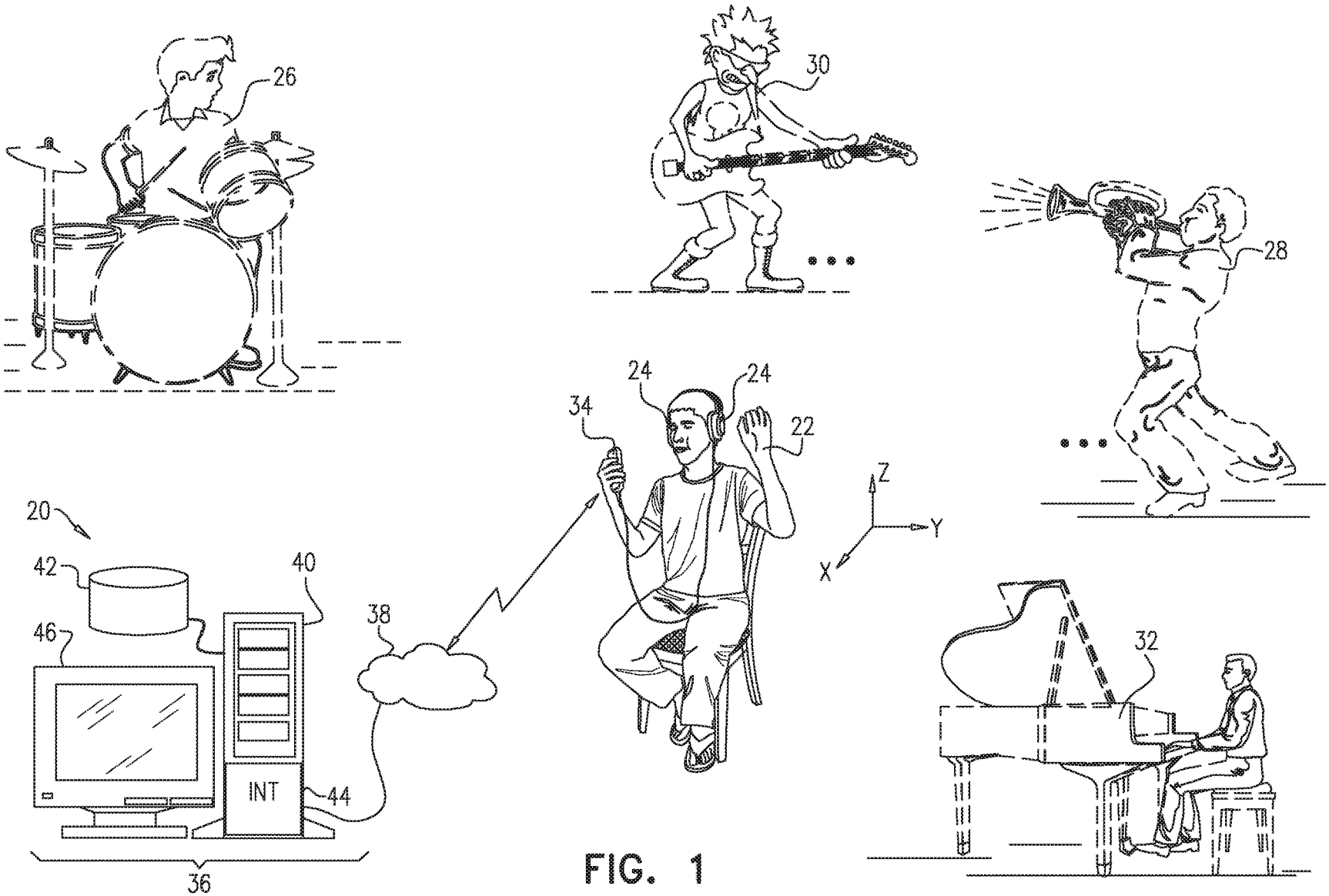
FIG. 1 is a schematic, pictorial illustration of a system for audio synthesis and playback, in accordance with an embodiment of the invention.

Audio mixing and editing tools that are known in the art enable the user to combine multiple input audio tracks (recorded from different instruments and/or voices, for example) into left and right stereo output signals. Such tools, however, generally provide only limited flexibility in dividing the inputs between the left and right outputs and cannot duplicate the sense of audio immersion that the listener gets from a live environment. Methods that are known in the art for converting surround sound to stereo are similarly incapable of preserving the immersive audio experience of the original recording.

Embodiments of the present invention that are described herein provide methods, systems and software for synthesizing sound that are able to realistically reproduce a full three-dimensional (3D) audio environment through stereo headphones. These embodiments make use, in a novel way, of the response of human listeners to spatial audio cues, which includes not only differences in the volume of sound heard by the left and right ears, but also differences in frequency response of the human auditory system as a function of both azimuth and elevation. In particular, some embodiments use filter response functions that comprise a notch at a given frequency, which varies as a function of the elevation coordinates of the audio sources.

In the disclosed embodiments, a processor receives one or more monaural audio tracks as inputs, as well as a respective 3D source location associated with each input. A user of the system is able to specify these source locations arbitrarily, at least in terms of azimuth and elevation coordinates of each source, for example, as well as distance. Thus, multiple sources of musical tracks, video soundtracks (such as movies or games) and/or other environmental sounds may be specified not only in the horizontal plane, but also at different elevations above and below the head level of the listener.

To convert the audio track or tracks into stereo signals, the processor assigns respective left and right filter responses to each of the inputs, based on filter response functions that depend upon the azimuth and elevation coordinates of the respective 3D source locations. The processor applies these filter responses to the corresponding inputs in order to synthesize the left and right stereo output signals. When multiple inputs, with different, respective source locations, are to be mixed together, the processor applies the appropriate, respective left and right filter responses to each of the inputs to generate respective left and right stereo components. The left stereo components are then summed over all of the inputs in order to generate the left stereo output, and the right stereo components are likewise summed to generate the right stereo output. A limiter may be applied to the summed components in order to prevent clipping upon playback of the output signals.

Some embodiments of the present invention enable the processor to simulate movement of an audio source along a 3D trajectory in space, so that the stereo output gives the listener the sense that the audio source is actually moving during playback. For this purpose, a user may input start and end points and corresponding start and end times of the trajectory. The processor automatically computes the 3D trajectory on this basis, possibly by calculating a path over the surface of a sphere that is centered at the origin of the azimuth and elevation coordinates of the start and end points. Alternatively, the user may input arbitrary sequences of points in order to generate trajectories of substantially any desired geometrical properties.

Regardless of how the trajectory is derived, the processor calculates, at multiple points along the 3D trajectory, filter responses that vary as a function of the azimuth and elevation coordinates of the points, and possibly in terms of distance coordinates, as well. The processor then sequentially applies these filter responses to the corresponding audio input in order to create the illusion that the audio source has moved along the trajectory between the start and end points over a period between specified start and end times. This capability may be used, for example, to simulate the feeling of a live performance, in which singers and musicians move around the theater, or to enhance the sense of realism in computer games and entertainment applications.

To enhance the richness and authenticity of the listener's audio experience, it can be beneficial to add virtual audio sources at additional locations besides those that are actually specified by the user. For this purpose, the processor spatially upsamples the input audio tracks in order to generate additional, synthesized inputs, having their own, synthesized 3D source locations that are different from the respective 3D source locations associated with the actual inputs. The upsampling can be performed by transforming the inputs to the frequency domain, for example using a wavelet transform, and then interpolating between the resulting spectrograms to generate the synthesized inputs. The processor filters the synthesized inputs using the filter response functions appropriate for the azimuth and elevation coordinates of their synthesized source locations, and then sums the filtered synthesized inputs with the filtered actual inputs to produce the stereo output signals.

The principles of the present invention may be applied in producing stereo outputs in a wide range of applications, for example:

- Synthesizing a stereo output from one or more monaural tracks with arbitrary source locations specified by the user, possibly including moving locations.
- Converting surround-sound recordings (such as 5.1 and 7.1) to stereo output, wherein the source locations correspond to standard speaker locations.
- Real-time stereo generation from live concerts and other live events, with simultaneous input from multiple microphones placed at any desired source locations, and on-line down-mixing to stereo. (A device to perform this sort of real-time down-mixing could be installed, for example, in a broadcast van that is parked at the site of the event.)

Other applications will be apparent to those skilled in the art after reading the present description. All such applications are considered to be within the scope of the present invention.

System Description

FIG. 1 is a schematic, pictorial illustration of a system 20 for audio synthesis and playback, in accordance with an embodiment of the invention. System 20 receives multiple audio inputs, each comprising a respective monaural audio track, along with corresponding location inputs indicating respective three-dimensional (3D) source locations having azimuth and elevation coordinates to be associated with the audio inputs. The system synthesizes left and right stereo output signals, which are played back in the present example on stereo headphones 24 worn by a listener 22.

The inputs typically comprise monaural audio tracks, represented in FIG. 1 by musicians 26, 28, 30 and 32, each in a different source location. The source locations are input to system 20 in coordinates relative to an origin located at the center of the head of listener 22. Taking the X-Y plane to be a horizontal plane through the listener's head, the coordinates of the sources can be specified in terms of both the azimuth (i.e., the source angle projected onto the X-Y plane) and the elevation above or below the plane. In some cases, the respective ranges of the sources (i.e., the distance from the origin) can also be specified, although range is not considered explicitly in the embodiments that follow.

The audio tracks and their respective source location coordinates are typically input by a user of system 20 (for example, listener 22 or a professional user, such as a sound engineer). In the case of musicians 28 and 30, the source locations that are input by the user vary over time, to simulate movement of the musicians while playing their respective parts. In other words, even when the input audio tracks are recorded by a static, monophonic microphone, with the musicians stationary during the recording, for example, the user is able to cause the output to simulate a situation in which one or more of the musicians are moving. The user can input the movements in terms of a trajectory, with start and end points in space and time. The resulting stereo output signals will give listener 22 a perception of motion of these audio sources in three dimensions.

In the pictured example, the stereo signals are output to headphones 24 by a mobile device 34, such as a smartphone, which receives the signals by a streaming link from a server 36 via a network 38. Alternatively, an audio file containing the stereo output signals may be downloaded to and stored in the memory of mobile device 34, or may be recorded on fixed media, such as an optical disk. Alternatively, the stereo signals may be output from other devices, such as a set-top box, a television, a car radio or car entertainment system, a tablet, or a laptop computer, inter alia.

It is assumed in the description that follows, for the sake of clarity and concreteness, that server 36 synthesizes the left and right stereo output signals. Alternatively, however, application software on mobile device 34 may perform all or a part of the steps involved in converting input tracks with associated locations into a stereo output in accordance with embodiments of the present invention.

Server 36 comprises a processor 40, typically a general-purpose computer processor, which is programmed in software to carry out the functions that are described herein. This software may be downloaded to processor 40 in electronic form, over a network, for example. Alternatively or additionally, the software may be stored on tangible, non-transitory computer-readable media, such as optical, magnetic or electronic memory media. Further alternatively or additionally, at least some of the functions of processor 40 that are described herein may be carried out by a programmable digital signal processor (DSP) or by other programmable or hard-wired logic. Server 36 further comprises a memory 42 and interfaces, including a network interface 44 to network 38 and a user interface 46, either of which can serve as an input interface to receive audio inputs and respective source locations.

As explained earlier, processor 40 applies to each of the inputs represented by musicians 26, 28, 30, 32, . . . , respective left and right filter responses based on filter response functions that depend upon the azimuth and elevation coordinates of the respective 3D source locations, and thus generates respective left and right stereo components. Processor 40 sums these left and right stereo components over all of the inputs in order to generate the left and right stereo outputs. Details of this process are described hereinbelow.

Figure 2:
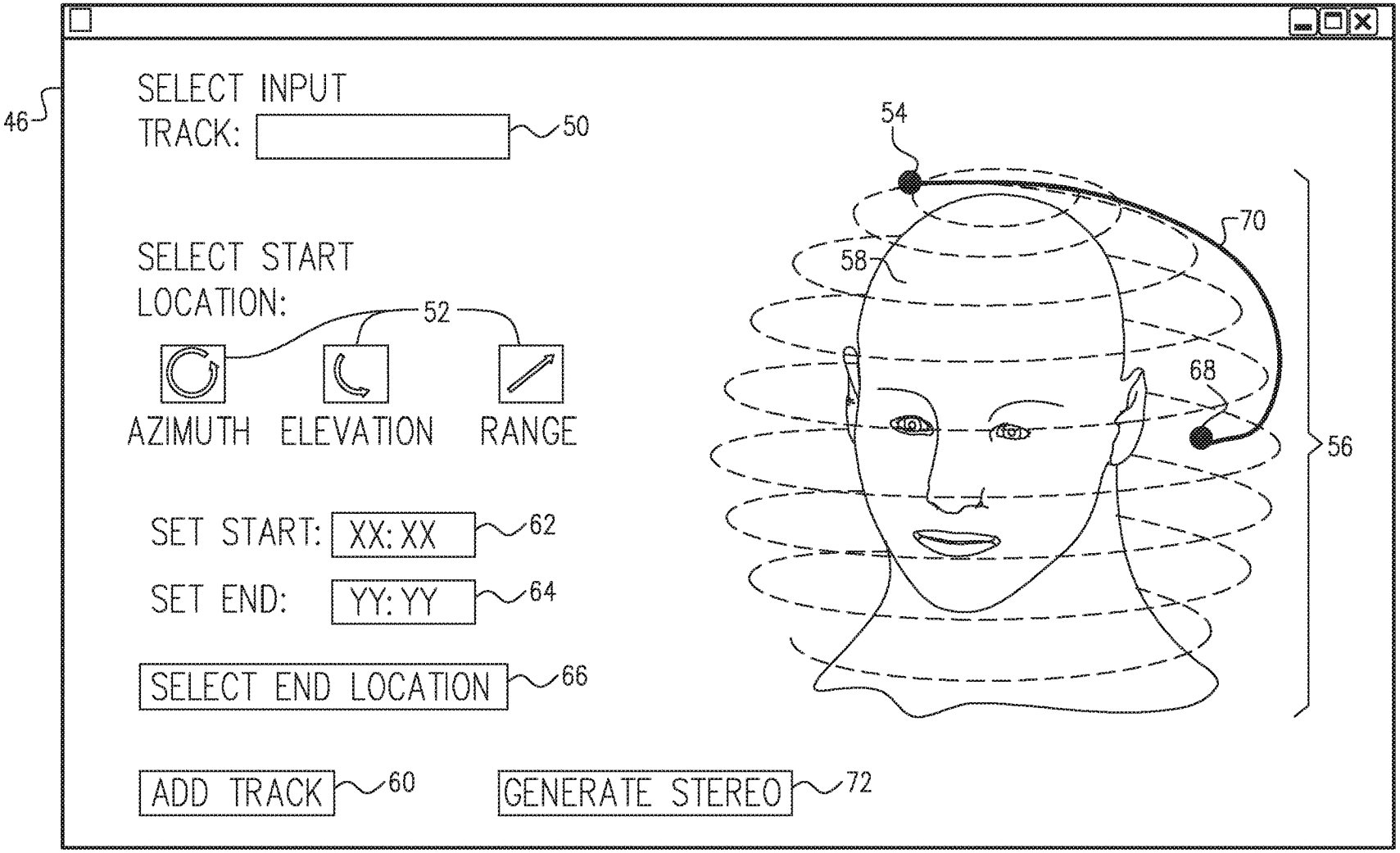
FIG. 2 is a schematic representation of a user interface screen in the system of FIG. 1, in accordance with an embodiment of the invention.

FIG. 2 is a schematic representation of a user interface screen, which is presented by user interface 46 of server 36 (FIG. 1) in accordance with an embodiment of the invention. This figure illustrates particularly how the user can specify the locations and, where appropriate, trajectories of the audio inputs to be used in generating the stereo output to headphones 24.

The user selects each input track by inputting a track identifier in an input field 50. For example, the user may browse audio files that are stored in memory 42 and enter the file name in field 50. For each input track, the user selects the initial location coordinates, in terms of azimuth, elevation and possible range (distance) relative to an origin at the center of the listener's head, using on-screen controls 52 and/or a dedicated user input device (not shown). The selected azimuth and elevation are marked as a start point 54 in a display area 56, which presents source locations relative to a head 58. When the source of the selected track is to be stationary, no further location input is required at this stage.

On the other hand, for source locations that are to move (as in the case of simulating the motion of musicians 28 and 30 in FIG. 1), screen 46 enables the user to specify a 3D trajectory 70 in space. For this purpose, controls 52 are adjusted to indicate start point 54 of the trajectory, and a start time input 62 is selected by the user to indicate the start time of the trajectory. Similarly, the user enters the end time and an end point 68 of the trajectory using an end time input 64 and an end location input 66 (typically using azimuth, elevation and possibly range controls, like controls 52). Optionally, to generate more complex trajectories, the user may input additional points in space and time along the course of the desired path.

As a further option, when the stereo output to be generated by server 36 is to be coupled as a sound track to a video clip, the user may indicate start and end times in terms of start and end frames in the video clip. In this use case, the user may, additionally or alternatively, indicate the audio source locations by pointing to locations in certain video frames.

Based on the above user inputs, processor 40 automatically computes 3D trajectory 70 between start point 54 and end point 68, with a speed selected so that the trajectory is traversed from the start time to the end time. In the pictured example, trajectory 70 comprises a path over the surface of a sphere that is centered at the origin of the azimuth, elevation and range coordinates. Alternatively, processor 40 may compute more complex trajectories, either fully automatically or interactively, under control of the user.

When the user has specified trajectory 70 of a given audio input track, processor 40 assigns and applies to this track filter responses that vary over the trajectory, based on the azimuth, elevation and range coordinates of the points along the trajectory. Processor 40 sequentially applies these filter responses to the audio input so that the corresponding stereo components will change over time in accordance with the current coordinates along the trajectory.

Methods for Audio Synthesis

Figure 3:
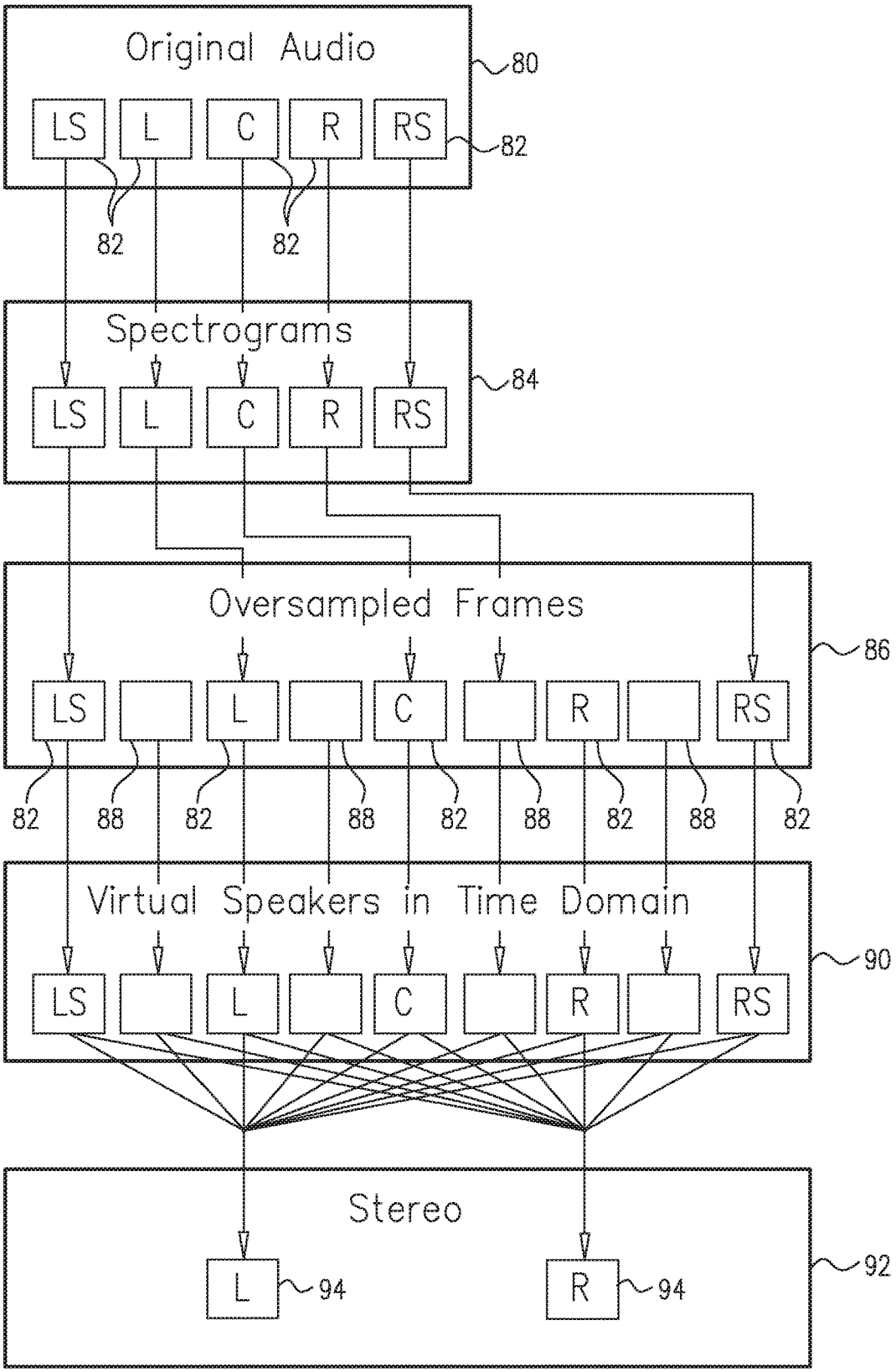
FIG. 3 is a flow chart that schematically illustrates a method for converting a multi-channel audio input into a stereo output, in accordance with an embodiment of the invention.

FIG. 3 is a flow chart that schematically illustrates a method for converting a multi-channel audio input into a stereo output, in accordance with an embodiment of the invention. In this example, the facilities of server 36 are applied in converting a 5.1 surround input 80 into a two-channel stereo output 92. Thus, in contrast to the preceding example, processor 40 receives five audio input tracks 82 with fixed source locations, corresponding to the positions of center (C), left (L), right (R), and left and right surround (LS, RS) speakers in the 5.1 system. Similar techniques may be applied in conversion of 7.1 surround inputs to stereo, as well as in conversion of multi-track audio inputs with any desired distribution of source locations (standard or otherwise) in 3D space.

To enrich the listener's audio experience, processor 40 up-mixes (i.e., upsamples) input tracks 82, to create synthesized inputs—"virtual speakers"—at additional source locations in the 3D space surrounding the listener. The up-mixing in this embodiment is performed in the frequency domain. Therefore, as a preliminary step, processor 40 transforms input tracks 82 into corresponding spectrograms 84, for example by applying a wavelet transform to the input audio tracks. Spectrograms 84 can be represented as a two dimensional plot of frequency over time.

The wavelet transform decomposes each of the audio signals into a set of wavelet coefficients using a zero-mean damped finite function (mother wavelet), localized in time and frequency. The continuous wavelet transform is the sum over all time of the signal multiplied by scaled, shifted versions of the mother wavelet. This process produces wavelet coefficients that are a function of scale and position. The mother wavelet used in the present embodiment is the complex Morlet wavelet, comprising a sine curve modulated by a Gaussian, defined as follows:

$$\Psi_0(\eta)=\pi^{-1/4}e^{i\omega_0\eta}e^{-\eta^2/2}$$

Alternatively, other sorts of wavelets may be used for this purpose. Further alternatively, the principles of the present invention may be applied, mutatis mutandis, using other time- and frequency-domain transformations to decompose the multiple audio channels.

In mathematical terms, the continuous wavelet transform is formulated as:

$$W_n^X(s)=\sum_{n'=1}^{N} x_{n'}\psi_0\left[(n'-n)\frac{\delta t}{s}\right]$$

Here $x_n$ is the digitized time series with time steps $\delta t$, n=1, . . . , N, s is the scale, and $\psi_0(\eta)$ is the scaled and translated (shifted) mother wavelet. The wavelet power is defined as $|W_n^X(s)|^2$.

The Morlet mother wavelet is normalized by a factor of $\sqrt{(\beta t/s)}$ for a signal with time steps $\delta t$, wherein s is the scale. In addition, the wavelet coefficients are normalized by the variance of the signal ($\sigma^2$) to create values of power relative to white noise.

For ease of computation, the continuous wavelet transform can alternatively be expressed as follows:

$$W_n(s) = \sum_{k=0}^{N-1} \hat{x}_k \hat{\psi} * (s\omega_k) e^{i\omega_k n\delta t}$$

$$\omega_k = \begin{cases} \frac{2\pi k}{N\delta t} : k \le \frac{N}{2} \\ -\frac{2\pi k}{N\delta t} : k > \frac{N}{2} \end{cases}$$

Here $\hat{x}_k$ is the Fourier transform of the signal $x_n$; $\hat{\psi}$ is the Fourier transform of the mother wavelet; * indicates the complex conjugate; s is scale; k=0 . . . N−1; and i is the basic imaginary unit $\sqrt{-1}$.

Processor 40 interpolates between spectrograms 84 according to the 3D source locations of the speakers in input 80 in order to generate a set of oversampled frames 86, including both the original input tracks 82 and synthesized inputs 88. To carry out this step, processor 40 computes interim spectrograms, which represent the virtual speakers in the frequency domain at respective locations in the spherical space surrounding the listener. For this purpose, in the present embodiment, processor 40 treats each pair of adjacent speakers as "movie frames," with the data points in the spectrogram as "pixels," and interpolates a frame that is virtually positioned in space and time between them. In other words, spectrograms 84 of the original audio channels in the frequency domain are treated as images, wherein x is time, y is frequency, and color intensity is used to indicate the spectral power or amplitude.

Between each pair of frames $F_0$ and $F_1$, at respective times $t_0$ and $t_1$, processor 40 inserts a frame $F_i$, which is an interpolated spectrogram matrix at time t, comprising pixels with (x,y) coordinates, given as:

$$t_i=(t-t_0)/(t_1-t_0)$$

$$F_{i,x,y}=(1-t_i)F_{0,x,y}+t_iF_{1,x,y}$$

Some embodiments also take into consideration the motion of high-power elements within the spectrogram.

Processor 40 gradually deforms this "image" according to the optical flow. The optical flow field $V_{x,y}$ defines, for each pixel (x,y), a vector with two elements, [x,y]. For each pixel (x,y) in the resulting image, processor 40 looks up the flow vector in field $V_{x,y}$, for example using an algorithm that is described below. This pixel is considered to have "come from" a point that lies back along the vector $V_{x,y}$, and will "go to" a point along the forward direction of the same vector. Since $V_{x,y}$ is the vector from pixel (x,y) in the first frame to the corresponding pixel in the second frame, processor 40 can use this relation to find the back coordinates $[x_b,y_b]$ and forward coordinates $[x_f,y_f]$, which are used in interpolating the intermediate "images":

$$t_i=(t-t_0)/(t_1-t_0)$$

$$[x_b,y_b]=[x,y]-t_iV_{x,y}$$

$$[x_f,y_f]=[x,y]+(1-t_i)V_{x,y}$$

$$F_{i,x,y}=(1-t_i)F_{0,xb,yb}+t_iF_{1,xf,yf}$$

To determine the flow vector V, described above, processor 40 divides the first frame into square blocks (of a predetermined size, here denoted as "s"), and these blocks are matched against blocks of the same size in the second frame, within a maximal distance d between the blocks to be matched. The pseudo code for this process is as follows:

TABLE I

FLOW VECTOR COMPUTATION

```
block-from-firstframe = crop (firstframe, x, y, x+s, y+s);
closest-difference = inf;
best-position = [x,y];
for (dx=−d:d)
  for (dy=−d:d)
    block-from-secondframe = crop(secondframe, x+dx, y+dy,
    x+s+dx, y+s+dy);
        difference-between-blocks = block-from-firstframe −
        block-from-secondframe;
    sum = difference-between-blocks.^2;
    if sum<closest-difference
      closest__difference = sum;
      best-position = [x+dx,y+dy];
    end
  end
end
        flow-vector(x,y) = best-position − [x,y];
```

Once the spectrograms have been computed for all the virtual speakers (synthesized inputs 88), as described above, processor 40 applies a wavelet reconstruction to regenerate a time domain representation 90 of both actual input tracks 82 and synthesized inputs 88. The following wavelet reconstruction algorithm, for example, based on a delta function, can be used:

$$x_n = \frac{\delta_j \delta_t^{1/2}}{C_\delta \psi_0(0)} \sum_{j=j_1}^{j_2} \frac{\Re\{W_n(s_j)\}}{s_j^{1/2}}$$

Here $x_n$ is the reconstructed time series with time steps δt; $\delta_j$ is the frequency resolution; $C_\delta$ is a constant that equals 0.776 for a Morlet wavelet with $\omega_0=6$; $\psi_0(0)$ is derived from the mother wavelet and equals $\pi^{-1/4}$; J is the number of scales; j is an index defining the limits of the filter, wherein $j=j_1 \ldots j_2$ and $0 \le j_1 < j_2 \le J$; $s_j$ is the $j_{th}$ scale; and $\Re$ is the real part of the complex wavelet $W_n$.

In order to down-mix time-domain representations 90 to a stereo output 92, processor 40 filters the actual and synthesized inputs using filter response functions computed at the azimuth and elevation coordinates of each of the actual and synthesized 3D source locations. This process uses an HRTF database of filters, and possibly also notch filters corresponding to the respective elevations of the source locations. For each channel signal, denoted as x(n), processor 40 convolves the signal with the pair of left and right HRTF filters that match its location relative to the listener. This computation typically uses a discrete time convolution:

$$yL(n) = \sum_{i=0}^{N-1} x[n-i] * hL[i]$$

$$yR(n) = \sum_{i=0}^{N-1} x[n-i] * hR[i]$$

Here x is an audio signal that is the output of the wavelet reconstruction described above, representing an actual or virtual speaker, n is the length of that signal, and N is the length of the left HRTF filter hL and the right HRTF filter hR. The outputs of these convolutions are the left and right components of the output stereo signal, denoted accordingly as yL and yR.

For example, given a virtual speaker at an elevation of 50° and azimuth of 60°, the audio will be convolved with the left HRTF filter associated with these directions and with the right HRTF filter associated with these directions, and possibly also with notch filters corresponding to the 50° elevation. The convolutions will create left and right stereo components, which will give the listener the perception of directionality of sound. Processor 40 repeats this computation for all the speakers in time domain representation 90, wherein each speaker is convolved with a different filter pair (according to the corresponding source location).

In addition, in some embodiments, processor 40 also modifies the audio signals according to the respective ranges (distances) of the 3D source locations. For example, processor 40 may amplify or attenuate the volume of a signal according to the range. Additionally or alternatively, processor 40 may add reverberation to one or more of the signals with increasing range of the corresponding source location.

After filtering all of the signals (actual and synthesized) using the appropriate left and right filter responses, processor 40 sums the filtered results to produce stereo output 92, comprising a left channel 94 that is the sum of all the yL components generated by the convolutions, and a right channel 94 that is the sum of all the yR components.

Figure 4:
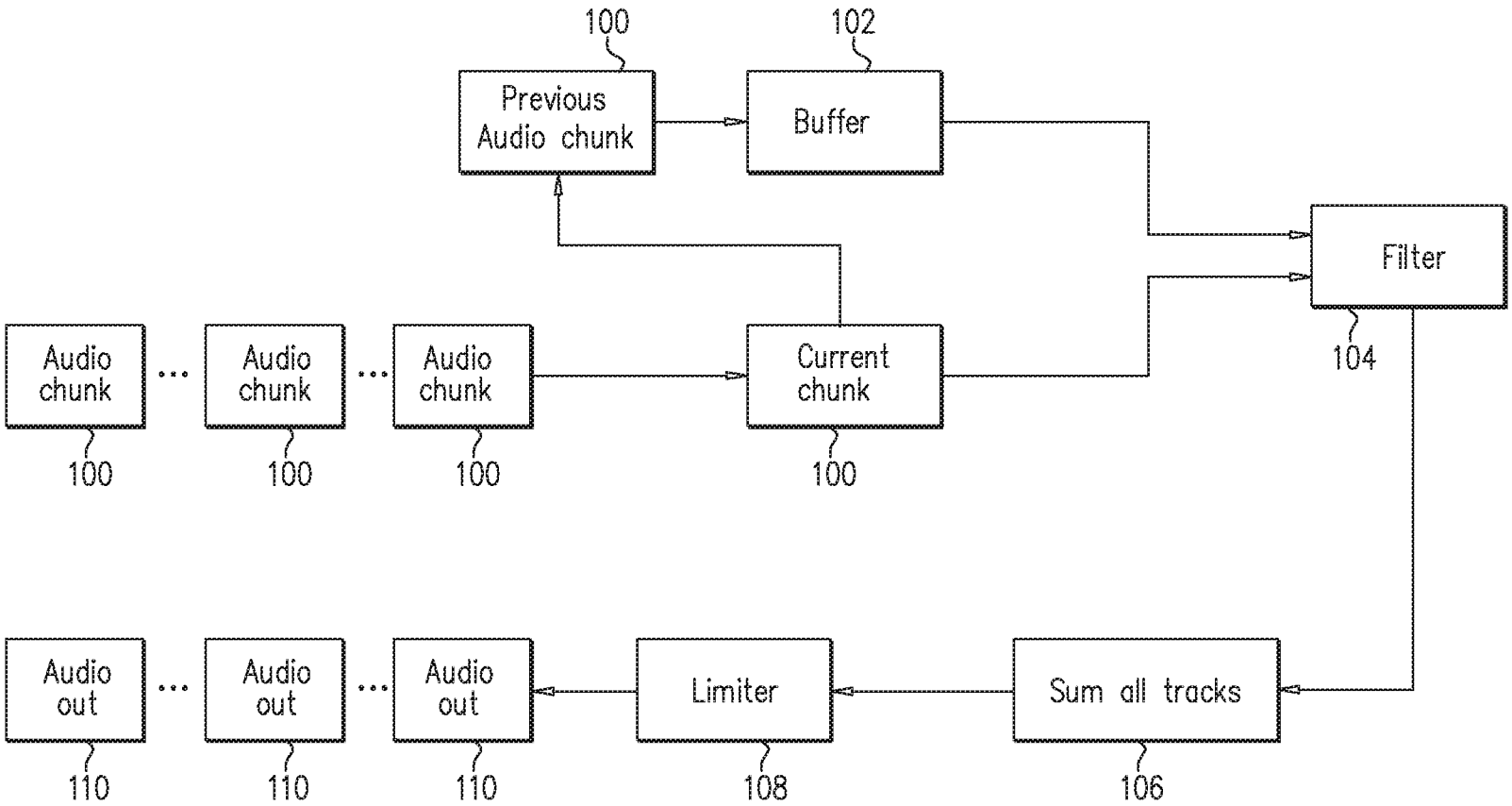
FIG. 4 is a block diagram that schematically illustrates a method for synthesizing an audio output, in accordance with an embodiment of the invention.

FIG. 4 is a block diagram that schematically illustrates a method for synthesizing these left and right audio output components, in accordance with an embodiment of the invention. In this embodiment, processor 40 is able to perform all calculations in real time, and server 36 can thus stream the stereo output on demand to mobile device 34. To reduce the computational burden, server 36 may forgo the addition of "virtual speakers" (as provided in the embodiment of FIG. 3), and use only the actual input tracks in generating the stereo output. Alternatively, the method of FIG. 4 can be used to generate stereo audio files off-line, for subsequent playback.

In one embodiment, processor 40 receives and operates on audio input chunks 100 of a given size (for example, 65536 bytes from each of the input channels). Processor temporarily saves the chunks in a buffer 102, and processes each chunk together with a previous, buffered chunk in order to avoid discontinuities in the output at the boundaries between successive chunks. Processor 40 applies filters 104 to each chunk 100 in order to convert each input channel into left and right stereo components with proper directional cues, corresponding to the 3D source location associated with the channel. A suitable filtering algorithm for this purpose is described hereinbelow with reference to FIG. 5.

Processor 40 next feeds all of the filtered signals on each side (left and right) to a summer 106, in order to compute the left and right stereo outputs. To avoid clipping on playback, processor 40 may apply a limiter 108 to the summed signals, for example according to the following equation:

$$Y = x * \frac{(27 + x^2)}{27 + 9 * x^2}$$

Here x is the input signal to the limiter, and Y is the output. The resulting stream of output chunks 110 can now be played back on stereo headphones 24.

Figure 5:
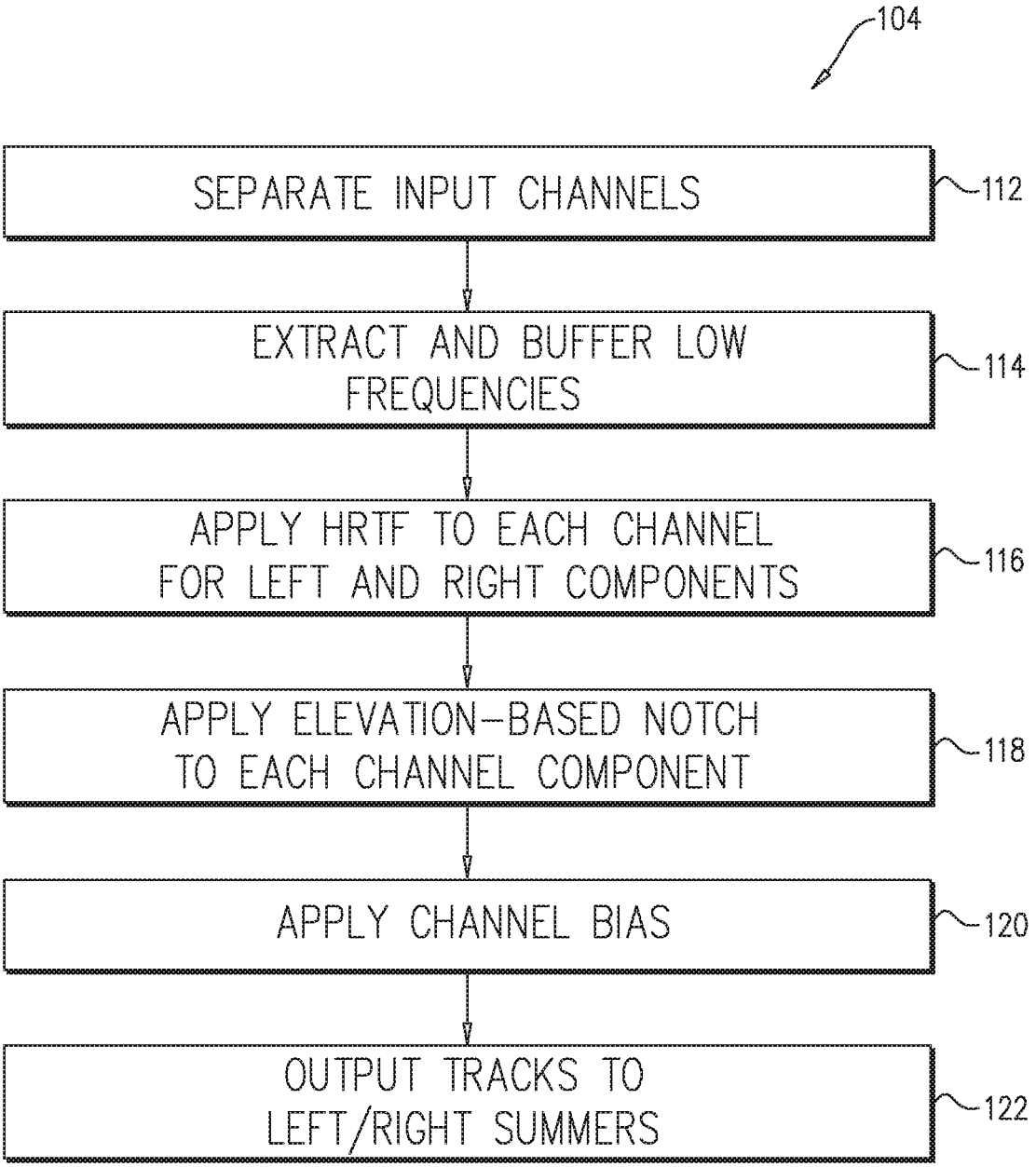
FIG. 5 is a flow chart that schematically illustrates a method for filtering audio signals, in accordance with an embodiment of the invention.

FIG. 5 is a flow chart that schematically shows details of filters 104, in accordance with an embodiment of the invention. Similar filters can be used, for example, in downmixing time domain representation 90 to stereo output 92 (FIG. 3), as well as in filtering inputs from sources that are to move along virtual trajectories (as illustrated in FIG. 2). When audio chunks 100 contain multiple channels in an interleaved format (as is common in some audio standards), processor 40 begins by breaking out the input channels into separate streams, at a channel separation step 112.

The inventors have found that some signal filters result in distortion of low-frequency audio components, while on the other hand, the listener's sense of directionality is based on cues in the higher frequency range, above 1000 Hz. Therefore, processor 40 extracts the low-frequency components from the individual channels (except the subwoofer channel, when present), and buffers the low-frequency components as a separate set of signals, at a frequency separation step 114.

In one embodiment, the separation of the low-frequency signal is achieved using a crossover filter, for example a crossover filter having a cutoff frequency of 100 Hz and order 16. The crossover filter may be implemented as an infinite impulse response (IIR) Butterworth filter, having a transfer function H that can be represented in digital form by the following equation:

$$H(z) = \prod_{k=1}^{L} \frac{b_{0k} + b_{1k} z^{-1} + b_{2k} z^{-2}}{a_{0k} + a_{1k} z^{-1} + a_{2k} z^{-2}}$$

Here z is a complex variable and L is the length of the filter. In another embodiment, the crossover filter is implemented as a Chebyshev filter.

Processor 40 sums together the resulting low-frequency components of all the original signals. The resulting low-frequency signal, referred to herein as Sub', is duplicated and later incorporated into both of the left and right stereo channels. These steps are useful in preserving the quality of the low-frequency components of the input.

Processor 40 next filters the high-frequency component of each of the individual channels with filter responses corresponding to the respective channel locations, in order to create the illusion that each component emanates from the desired direction. For this purpose, processor 40 filters each channel with appropriate left and right HRTF filters, to allocate the signal to a specific azimuth in the horizontal plane, at an azimuth filtering step 116, and with a notch filter, to allocate the signal to a specific elevation, at an elevation filtering step 118. The HRTF and notch filters are described here separately for the sake of conceptual and computational clarity but may alternatively be applied in a single computational operation.

The HRTF filter can be applied at step 116 using the following convolutions:

$$y_{left}(n) = \sum_{m=-\infty}^{\infty} x(m) h_{left}(n - m)$$

$$y_{right}(n) = \sum_{m=-\infty}^{\infty} x(m) h_{right}(n - m)$$

Here y(n) are the processed data, n is a discrete time variable, x is a chunk of the audio samples being processed, and h is the kernel of the convolution representing the impulse response of the appropriate HRTF filter (left or right). The notch filters applied at step 118 can be finite impulse response (FIR) constrained least squares filters, and can likewise be applied by convolution, similarly to the HRTF filters shown in the above formulas. Detailed expressions of filter coefficients that can be used in the HRTF and notch filters in a number of example scenarios are presented in the above-mentioned U.S. Provisional Patent Application 62/400,699.

Processor 40 need not apply the same processing conditions to all channels, but may rather apply a bias to certain channels in order to enhance the listener's auditory experience, at a biasing step 120. For example, the inventors have found it beneficial in some cases to bias the elevations of certain channels, by adjusting the corresponding notch filters so that the 3D source locations of the channels are perceived to be below the horizontal plane. As another example, processor 40 can boost the gain of the surround channels (SL and SR) and/or rear channels (RL and RR) received from a surround sound input in order to increase the volume of surround channels and thus enhance the surround effect on the audio coming from headphones 24. As another example, the Sub' channel, as defined above, may be attenuated relative to the high-frequency components or otherwise limited. The inventors have found that biases in the range of ±5 dB can give good results.

After application of the filters and any desired biases, processor 40 passes all of the left stereo components and all of the right stereo components, together with the Sub' component, to summers 106, at a filter output step 122. Generation and output of the stereo signals to headphones 24 then continues as described above.

It will be appreciated that the embodiments described above are cited by way of example, and that the present invention is not limited to what has been particularly shown and described hereinabove. Rather, the scope of the present invention includes both combinations and subcombinations of the various features described hereinabove, as well as variations and modifications thereof which would occur to persons skilled in the art upon reading the foregoing description and which are not disclosed in the prior art.

The invention claimed is:

1. A method for synthesizing sound, comprising:

receiving one or more first inputs, each first input comprising a respective monaural audio track;

receiving one or more second inputs indicating respective three-dimensional (3D) source locations having azimuth and elevation coordinates to be associated with the first inputs;

assigning to each of the first inputs respective left and right filter responses based on filter response functions that depend upon the azimuth and elevation coordinates of the respective 3D source locations; and synthesizing left and right stereo output signals by applying the respective left and right filter responses to the first inputs, wherein the one or more first inputs comprise a first plurality of audio input tracks, and wherein synthesizing the left and right stereo output signals comprises:

spatially upsampling the first plurality of the input audio tracks in order to generate a second plurality of synthesized inputs, having synthesized 3D source locations with respective coordinates different from the respective 3D source locations associated with the first inputs;

filtering the synthesized inputs using the filter response functions computed at the azimuth and elevation coordinates of the synthesized 3D source locations; and after filtering the first inputs using the respective left and right filter responses, summing the filtered synthesized inputs with the filtered first inputs to produce the stereo output signals.

2. The method according to claim 1, wherein the one or more first inputs comprise a plurality of first inputs, and wherein synthesizing the left and right stereo output signals comprises applying the respective left and right filter responses to each of the first inputs to generate respective left and right stereo components, and summing the left and right stereo components over all of the first inputs.

3. The method according to claim 2, wherein summing the left and right stereo components comprises applying a limiter to the summed components in order to prevent clipping upon playback of the output signals.

4. The method according to claim 1, wherein at least one of the second inputs specifies a 3D trajectory in space, and wherein assigning the left and right filter responses comprises specifying, at each of a plurality of points along the 3D trajectory, filter responses that vary over the trajectory responsively to the azimuth and elevation coordinates of the points, and wherein synthesizing the left and right stereo output signals comprises sequentially applying to the first input that is associated with the at least one of the second inputs the filter responses that are specified for the points along the 3D trajectory.

5. The method according to claim 1, wherein the filter response functions comprise a notch at a given frequency, which varies as a function of the elevation coordinates.

6. The method according to claim 1, wherein spatially upsampling the first plurality of the input audio tracks comprises applying a wavelet transform to the input audio tracks to generate respective spectrograms of the input audio tracks, and interpolating between the spectrograms according to the 3D source locations to generate the synthesized inputs.

7. The method according to claim 6, wherein interpolating between the spectrograms comprises computing an optical flow function between points in the spectrograms.

8. The method according to claim 1, wherein synthesizing the left and right stereo output signals comprises extracting low-frequency components from the first inputs, and wherein applying the respective left and right filter responses comprises filtering the first inputs after extraction of the low-frequency components, and then adding the extracted low-frequency components to the filtered first inputs.

9. The method according to claim 1, where the 3D source locations have range coordinates that are to be associated with the first inputs, and wherein synthesizing the left and right stereo outputs comprises further modifying the first inputs responsively to the associated range coordinates.

10. A method for synthesizing sound, comprising:

receiving one or more first inputs, each first input comprising a respective monaural audio track;

receiving one or more second inputs indicating respective three-dimensional (3D) source locations having azimuth and elevation coordinates to be associated with the first inputs;

assigning to each of the first inputs respective left and right filter responses based on filter response functions that depend upon the azimuth and elevation coordinates of the respective 3D source locations; and synthesizing left and right stereo output signals by applying the respective left and right filter responses to the first inputs, wherein at least one of the second inputs specifies a 3D trajectory in space, and wherein assigning the left and right filter responses comprises specifying, at each of a plurality of points along the 3D trajectory, filter responses that vary over the trajectory responsively to the azimuth and elevation coordinates of the points, and wherein synthesizing the left and right stereo output signals comprises sequentially applying to the first input that is associated with the at least one of the second inputs the filter responses that are specified for the points along the 3D trajectory, and wherein receiving the one or more second inputs comprises:

receiving a start point and a start time of the trajectory;

receiving an end point and an end time of the trajectory; and automatically computing the 3D trajectory between the start point and the end point such that the trajectory is traversed from the start time to the end time.

11. The method according to claim 5, wherein automatically computing the 3D trajectory comprises calculating a path over a surface of a sphere that is centered at an origin of the azimuth and elevation coordinates.

12. Apparatus for synthesizing sound, comprising:

an input interface configured to receive one or more first inputs, each first input comprising a respective monaural audio track, and to receive one or more second inputs indicating respective three-dimensional (3D) source locations having azimuth and elevation coordinates to be associated with the first inputs; and a processor, which is configured to assign to each of the first inputs respective left and right filter responses based on filter response functions that depend upon the azimuth and elevation coordinates of the respective 3D source locations, and to synthesize left and right stereo output signals by applying the respective left and right filter responses to the first inputs, wherein the one or more first inputs comprise a first plurality of audio input tracks, and wherein the processor is configured to spatially upsample the first plurality of the input audio tracks in order to generate a second plurality of synthesized inputs, having synthesized 3D source locations with respective coordinates different from the respective 3D source locations associated with the first inputs, to filter the synthesized inputs using the filter response functions computed at the azimuth and elevation coordinates of the synthesized 3D source locations, and to sum the filtered synthesized inputs with the filtered first inputs to produce the stereo output signals.

13. The apparatus according to claim 12, and comprising an audio output interface, comprising left and right speakers, which are configured to play back the left and right stereo output signals, respectively.

14. The apparatus according to claim 12, wherein the one or more first inputs comprise a plurality of first inputs, and wherein the processor is configured to apply the respective left and right filter responses to each of the first inputs to generate respective left and right stereo components, and to sum the left and right stereo components over all of the first inputs.

15. The apparatus according to claim 14, wherein the processor is configured to apply a limiter to the summed components in order to prevent clipping upon playback of the output signals.

16. The apparatus according to claim 12, wherein at least one of the second inputs specifies a 3D trajectory in space, and wherein the processor is configured to specify, at each of a plurality of points along the 3D trajectory, filter responses that vary over the trajectory responsively to the azimuth and elevation coordinates of the points, and to sequentially apply to the first input that is associated with the at least one of the second inputs the filter responses that are specified for the points along the 3D trajectory.

17. The apparatus according to claim 12, wherein the filter response functions comprise a notch at a given frequency, which varies as a function of the elevation coordinates.

18. The apparatus according to claim claim 12, wherein the processor is configured to spatially upsample the first plurality of the input audio tracks by applying a wavelet transform to the input audio tracks to generate respective spectrograms of the input audio tracks, and interpolating between the spectrograms according to the 3D source locations to generate the synthesized inputs.

19. The apparatus according to claim 18, wherein the processor is configured to interpolate between the spectrograms using an optical flow function computed between points in the spectrograms.

20. The apparatus according to claim 12, wherein the processor is configured to extract low-frequency components from the first inputs, to apply the respective left and right filter responses to the first inputs after extraction of the low-frequency components, and then to add the extracted low-frequency components to the filtered first inputs.

21. The apparatus according to claim 12, where the 3D source locations have range coordinates that are to be associated with the first inputs, and wherein the processor is configured to further modify the first inputs responsively to the associated range coordinates.

22. Apparatus for synthesizing sound, comprising:

an input interface configured to receive one or more first inputs, each first input comprising a respective monaural audio track, and to receive one or more second inputs indicating respective three-dimensional (3D) source locations having azimuth and elevation coordinates to be associated with the first inputs; and a processor, which is configured to assign to each of the first inputs respective left and right filter responses based on filter response functions that depend upon the azimuth and elevation coordinates of the respective 3D source locations, and to synthesize left and right stereo output signals by applying the respective left and right filter responses to the first inputs, wherein at least one of the second inputs specifies a 3D trajectory in space, and wherein the processor is configured to specify, at each of a plurality of points along the 3D trajectory, filter responses that vary over the trajectory responsively to the azimuth and elevation coordinates of the points, and to sequentially apply to the first input that is associated with the at least one of the second inputs the filter responses that are specified for the points along the 3D trajectory, and wherein the processor is configured to receive a start point and a start time of the trajectory and an end point and an end time of the trajectory, and to automatically compute the 3D trajectory between the start point and the end point such that the trajectory is traversed from the start time to the end time.

23. The apparatus according to claim 22, wherein the 3D trajectory comprises a path over a surface of a sphere that is centered at an origin of the azimuth and elevation coordinates.

24. A computer software product, comprising a non-transitory computer-readable medium in which program instructions are stored, which instructions, when read by a computer, cause the computer to receive one or more first inputs, each first input comprising a respective monaural audio track, and to receive one or more second inputs indicating respective three-dimensional (3D) source locations having azimuth and elevation coordinates to be associated with the first inputs, wherein the instructions cause the computer to assign to each of the first inputs respective left and right filter responses based on filter response functions that depend upon the azimuth and elevation coordinates of the respective 3D source locations, and to synthesize left and right stereo output signals by applying the respective left and right filter responses to the first inputs, and wherein the one or more first inputs comprise a first plurality of audio input tracks, and wherein the instructions cause the computer to spatially upsample the first plurality of the input audio tracks in order to generate a second plurality of synthesized inputs, having synthesized 3D source locations with respective coordinates different from the respective 3D source locations associated with the first inputs, to filter the synthesized inputs using the filter response functions computed at the azimuth and elevation coordinates of the synthesized 3D source locations, and to sum the filtered synthesized inputs with the filtered first inputs to produce the stereo output signals.

25. The product according to claim 24, wherein the one or more first inputs comprise a plurality of first inputs, and wherein the instructions cause the computer to apply the respective left and right filter responses to each of the first inputs to generate respective left and right stereo components, and to sum the left and right stereo components over all of the first inputs.

26. The product according to claim 25, wherein the instructions cause the computer to apply a limiter to the summed components in order to prevent clipping upon playback of the output signals.

27. The product according to claim 24, wherein at least one of the second inputs specifies a 3D trajectory in space, and wherein the instructions cause the computer to specify, at each of a plurality of points along the 3D trajectory, filter responses that vary over the trajectory responsively to the azimuth and elevation coordinates of the points, and to sequentially apply to the first input that is associated with the at least one of the second inputs the filter responses that are specified for the points along the 3D trajectory.

28. The product according to claim 24, wherein the filter response functions comprise a notch at a given frequency, which varies as a function of the elevation coordinates.

29. The product according to claim 24, wherein the instructions cause the computer to spatially upsample the first plurality of the input audio tracks by applying a wavelet transform to the input audio tracks to generate respective spectrograms of the input audio tracks, and interpolating between the spectrograms according to the 3D source locations to generate the synthesized inputs.

30. The product according to claim 29, wherein the instructions cause the computer to interpolate between the spectrograms using an optical flow function computed between points in the spectrograms.

31. The product according to claim 24, wherein the instructions cause the computer to extract low-frequency components from the first inputs, to apply the respective left and right filter responses to the first inputs after extraction of the low-frequency components, and then to add the extracted low-frequency components to the filtered first inputs.

32. The product according to claim 24, where the 3D source locations have range coordinates that are to be associated with the first inputs, and wherein the instructions cause the computer to further modify the first inputs responsively to the associated range coordinates.

33. A computer software product, comprising a non-transitory computer-readable medium in which program instructions are stored, which instructions, when read by a computer, cause the computer to receive one or more first inputs, each first input comprising a respective monaural audio track, and to receive one or more second inputs indicating respective three-dimensional (3D) source locations having azimuth and elevation coordinates to be associated with the first inputs, wherein the instructions cause the computer to assign to each of the first inputs respective left and right filter responses based on filter response functions that depend upon the azimuth and elevation coordinates of the respective 3D source locations, and to synthesize left and right stereo output signals by applying the respective left and right filter responses to the first inputs, and wherein at least one of the second inputs specifies a 3D trajectory in space, and wherein the instructions cause the computer to specify, at each of a plurality of points along the 3D trajectory, filter responses that vary over the trajectory responsively to the azimuth and elevation coordinates of the points, and to sequentially apply to the first input that is associated with the at least one of the second inputs the filter responses that are specified for the points along the 3D trajectory, and wherein the instructions cause the computer to receive a start point and a start time of the trajectory and an end point and an end time of the trajectory, and to automatically compute the 3D trajectory between the start point and the end point such that the trajectory is traversed from the start time to the end time.

34. The product according to claim 33, wherein the 3D trajectory comprises a path over a surface of a sphere that is centered at an origin of the azimuth and elevation coordinates.

* * * * *